US010730668B2

(12) United States Patent
Ross

(10) Patent No.: US 10,730,668 B2
(45) Date of Patent: Aug. 4, 2020

(54) DECORATIVE-HANDLED, TWIST-CLOSURE APPARATUS AND METHOD

(71) Applicant: Lisa Ross, Draper, UT (US)

(72) Inventor: Lisa Ross, Draper, UT (US)

( * ) Notice: Subject to any disclaimer, the term of this patent is extended or adjusted under 35 U.S.C. 154(b) by 36 days.

(21) Appl. No.: 16/197,811

(22) Filed: Nov. 21, 2018

(65) Prior Publication Data

US 2019/0225382 A1 Jul. 25, 2019

Related U.S. Application Data

(60) Provisional application No. 62/589,697, filed on Nov. 22, 2017.

(51) Int. Cl.

| | |
|---|---|
| ***B65D 33/00*** | (2006.01) |
| ***B65D 33/16*** | (2006.01) |
| ***B65D 63/12*** | (2006.01) |

(52) U.S. Cl.

CPC ..... *B65D 33/004* (2013.01); *B65D 33/165* (2013.01); *B65D 63/12* (2013.01); *B65D 2563/108* (2013.01)

(58) Field of Classification Search

CPC .... Y10T 24/157; B65D 33/165; B65D 33/12; B65D 2563/108; B65D 33/004

See application file for complete search history.

(56) References Cited

U.S. PATENT DOCUMENTS

| | | | | |
|---|---|---|---|---|
| 3,290,854 A * | 12/1966 | McMurray | ..... | B65D 63/10 53/417 |
| 3,409,948 A * | 11/1968 | Goodwin | ..... | B65D 63/10 24/16 R |
| 7,011,879 B1 * | 3/2006 | Contreras | ..... | B65D 33/30 24/30.5 T |
| 9,999,915 B2 * | 6/2018 | Clark | ..... | B21F 45/16 |

* cited by examiner

*Primary Examiner* — Robert Sandy

(74) *Attorney, Agent, or Firm* — Pate Baird, PLLC

(57) ABSTRACT

A combination decoration and wire-reinforced twist tie is made with a grip on each end. Width is selected to be part of the presentation, and includes multiple wires providing additional stability for positioning the grips as emblems as part of the presentation. Certain embodiments place the decorative element in the geographical center or elsewhere along the strand that forms the twist tie, thereby freeing the ends to become a bow-like decoration behind the shaped image of that center decorative element.

20 Claims, 6 Drawing Sheets

16a
17a 16b
17b 16c
17c 16d
17d
HAPPY BIRTHDAY 16e
17e 16f
17f

17g 16
14m
18m
12m
18m 12k
18k
14k 12j
14j 14h
18h
12h
18h 16
14
12
10

DECORATIVE-HANDLED, TWIST-CLOSURE APPARATUS AND METHOD

RELATED APPLICATIONS

This application claims the benefit of U.S. Provisional Patent Application Ser. No. 62/589,697, filed on Nov. 22, 2017. The foregoing reference is hereby incorporated herein by reference.

BACKGROUND

1. Field of the Invention

This invention relates to packaging and, more particularly, to novel systems and methods for twist closure of packaging.

2. The Background Art

Packaging is a technology applied in nearly infinite variety. Industrial packaging is typically configured to sustain substantial loads, stacking, movement, jostling, dropping, and so forth. To this end, boxes and other containers formed of many different materials from metals to composite polymeric materials, manufactured wood products, paper, plastics, and the like are used. Some containers are recycled or reused directly as they are, while others are knocked down to be re-assembled, and some are destroyed, or otherwise recycled only as to their materials.

The point is that packaging has purpose, and must then be dealt with otherwise. The purpose of a package may be dictated by environment, transportation, appearance, or the like. Typically, packaging may be thought of as the system for organizing objects of various sizes in such a way that they may be stacked and transported.

Another entirely different aspect of packaging is presentation. To a certain extent, retail sales are augmented by the advertising value and the pleasant impression that the presentation of packaging may make. Thus, some packaging has a presentation as a principal consideration and component. The package may present its contents or purposely obscure them.

The ultimate in obscured-content presentation is probably gift packaging. In gift packaging, presentation is the driving issue. Typically, a gift package will hide the gift until the appropriate time that the package is opened.

Meanwhile, such packaging may have a theme. The theme may relate, and often will, to the occasion for which the gift is a token of celebration or remembrance. Packaging may be focused on the nature of the materials, such as ribbon, fabrics, papers, stranded tying materials, and the like. Packaging may also focus on patterns printed on wrappings such as wrapping paper, boxes, bags, ribbons, or the like.

Sometimes, a closure is simply a large expanse of tissue paper folded or stuffed in such a way as to fill yet protrude from the top of a decorative bag, typically having handles at the mouth thereof. It would be an advance in the art to provide a new securement adapted to provide thematic or decorative contributions and more control over their presentation.

SUMMARY OF THE INVENTION

In view of the foregoing, in accordance with the invention as embodied and broadly described herein, a method and apparatus are disclosed in one embodiment of the present invention as including a band comprised of a field having a length and width and some amount of thickness, typically small. At each end of the band will be found a grip or emblem. The grip typically constitutes a shaped emblem containing an image on at least one side. Typically, the other side of the emblem opposite the image will typically be shaped only as the silhouette of the image.

Closures for packaging may still include tape, ribbon, raffia, string, and similar materials. Similarly, odd shapes may be simply wrapped in paper and secured with a stranded tying material.

An advance in the art is a mechanism for introducing thematic elements to packaging by way of the closure. For example, stranded material, whether straight ribbon, curling ribbon, raffia, string, or the like may be used to close an opening of a bag, a folded bundle, or typically a gathered bundle of wrapping material at a neck or narrowest constriction of that wrapping material.

In such a case, a bulk sheet of wrapping material may be wrapped around a gift or other article, often enclosing padding of some type, such as expanded polymeric foam, paper, or the like. The neck is typically constricted to provide a location for some type of tying, stranded material. The edges of the wrapping material thus collapse together in a pleated or fluted shape extending away from the neck in many directions. Ties suitable for the neck of such a package have conventionally been quite limited in their contribution to the overall decorative or thematic elements of the package or the occasion.

In certain contemplated embodiments, an apparatus in accordance with the invention may include ribs extending along the length of a band of stranded material. Ribs may be singular or multiple. Ribs may be numbered from one to any suitable number and may be glued to or embedded within a field of material, at the edges of the field (edges of the width thereof), or spaced apart throughout the field. The ribs may typically be a malleable metal.s The ribs may be formed of a plastic or other material that is less likely to yield (an engineering term of art used in that context and meaning) in order to maintain a new shape after being deformed (i.e., yielded, deflected non-elastically).

Each end of the band may include a grip or emblem secured to the band and bearing an image. Images may be selected from any suitable image of plant, animal, person, situation, symbol, article, message or the like. The apparatus as a securement mechanism may be wrapped around the neck of a package, such as the neck gathered together of wrapping paper folded around a gift or other object.

A band may be applied directly to certain objects, such as a bottle, a box, the mouth of a sack, or any other suitable shape about which the band may be sized to extend. The grip or emblem on each end may be used to draw the securement tighter and to twist the band about itself to secure it to the package.

Typically, owing to the ribs when formed of a stable, yieldable material, such as a yieldable wire, malleable wire, inelastically deformable polymer, or the like may stabilize the grips or emblems in a specific relationship to the package and to each other. For example, a pair of emblems may actually both be presented on a right hand side and left hand side of a centerline therebetween, with a specific orientation with respect to each other.

This arrangement may itself be particularly thematic. For example, the emblems may represent hearts, each with a different word or wording on it, a bride emblem and a groom emblem that may be standing facing one another, some other meaningful pair of images juxtaposed, or the like. Thus, a securement with packaging material about a gift or other article, including retail articles for sale, may provide an attractive, decorative, yet functional, aspect of the presentation. Together, such a securement, along with packaging may provide a system. The use thereof may provide a process for implementing such a system to a desired effect.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 13 is an elevation view of the securement of FIG. 1 illustrating in exploded view various, optional, alternative embodiments of grip emblems and band materials, wherein FIG. 13A through 13G represent grips or emblems, and FIGS. 13H, 13J, 13K, and 13M represent bands and their materials.

DETAILED DESCRIPTION OF THE PREFERRED EMBODIMENTS

Figure 1:
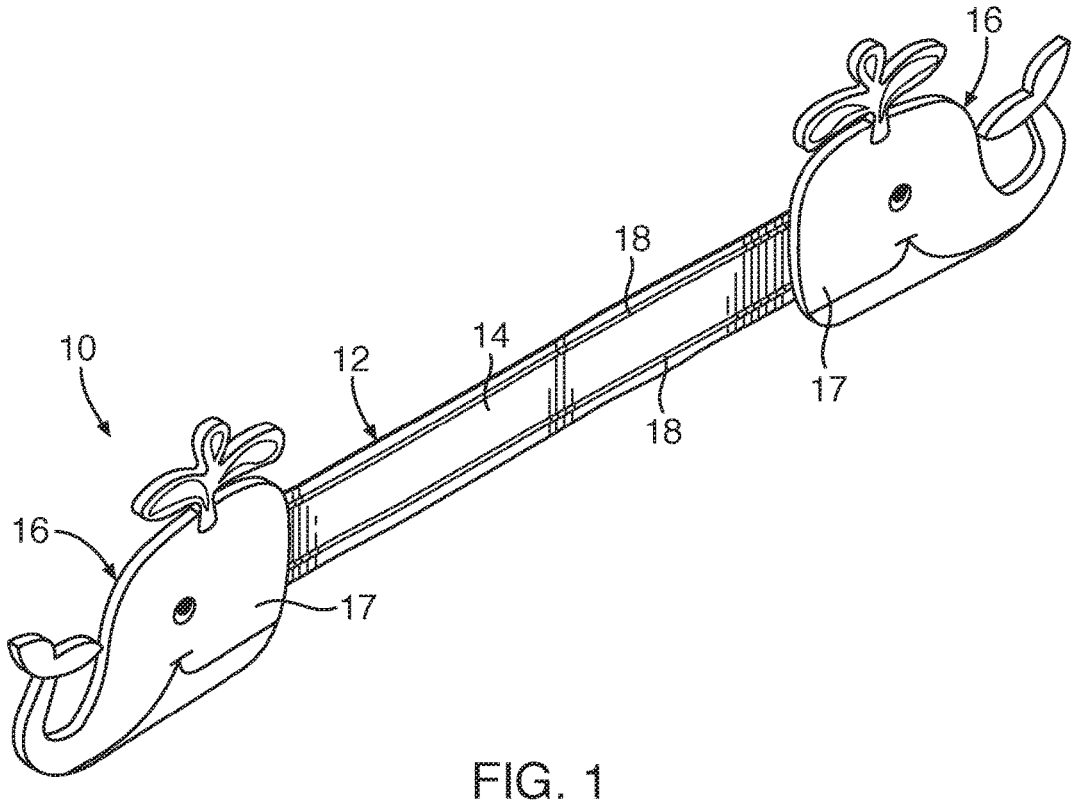
FIG. 1 is a frontal perspective view of one embodiment of a securement, in accordance with the invention, in an untwisted (open) configuration.
Figure 2:
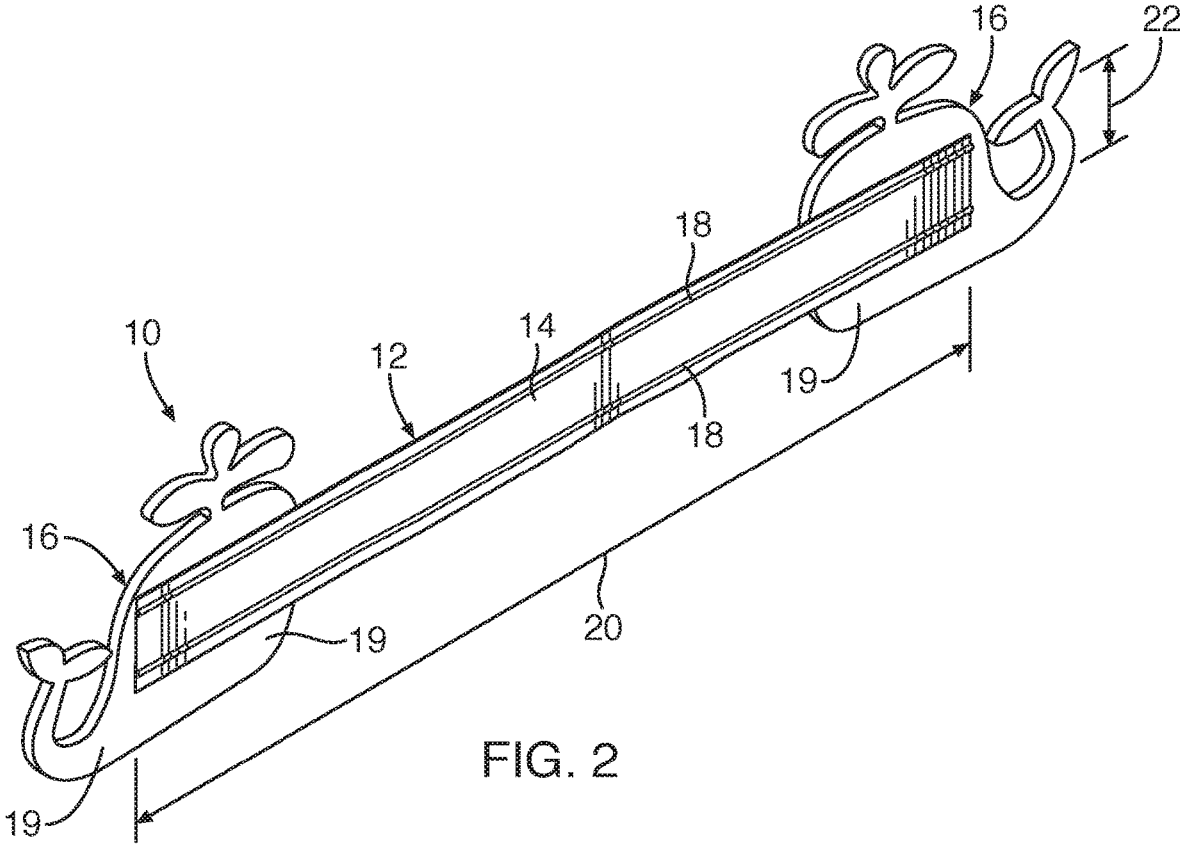
FIG. 2 is a rear perspective view thereof.
Figure 3:
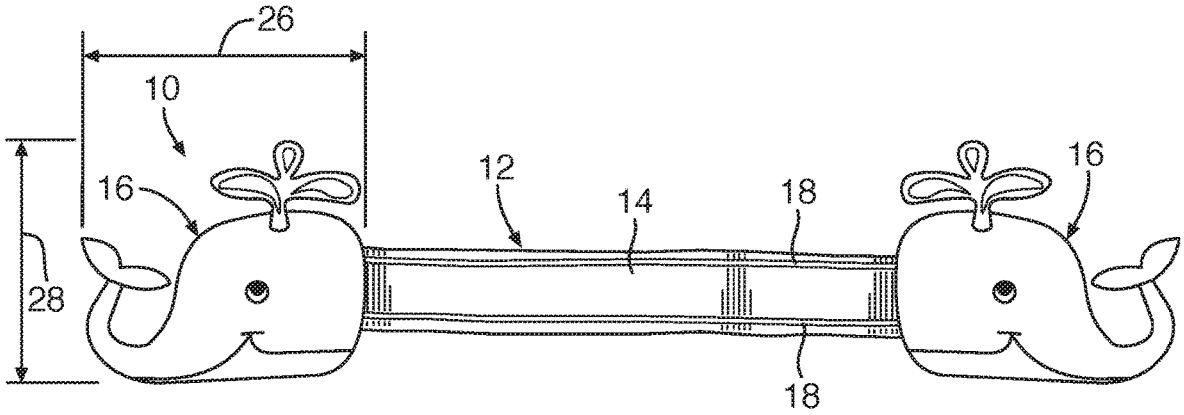
FIG. 3 is a front elevation view thereof, in an unapplied configuration.
Figure 4:
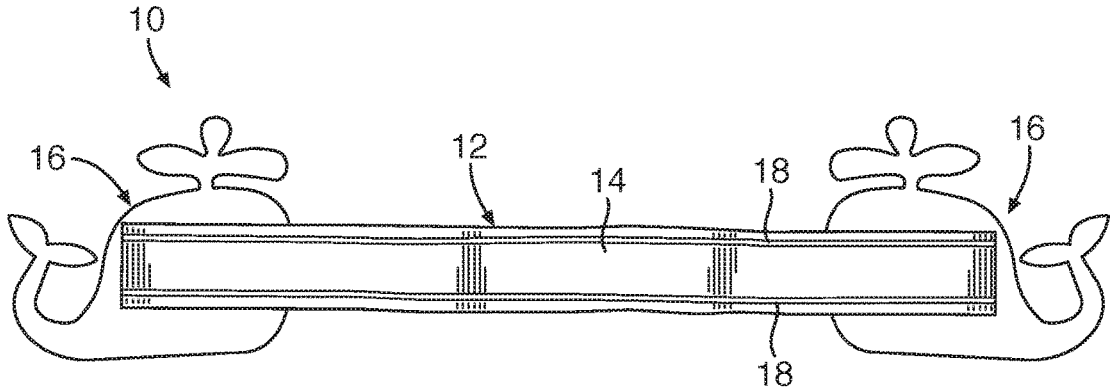
FIG. 4 is a rear elevation view thereof.
Figure 5A:
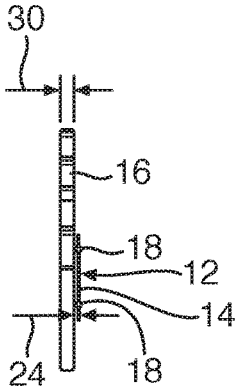
FIG. 5A is an end elevation view thereof.
Figure 5B:
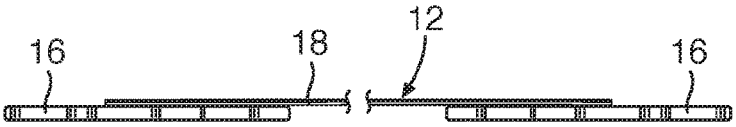
FIG. 5B is a top plan view thereof.
Figure 6:
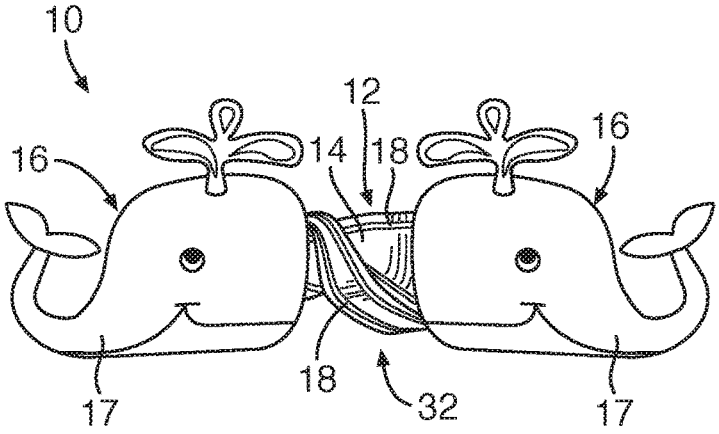
FIG. 6 is a front elevation view thereof in a twisted (closed) configuration.
Figure 7:
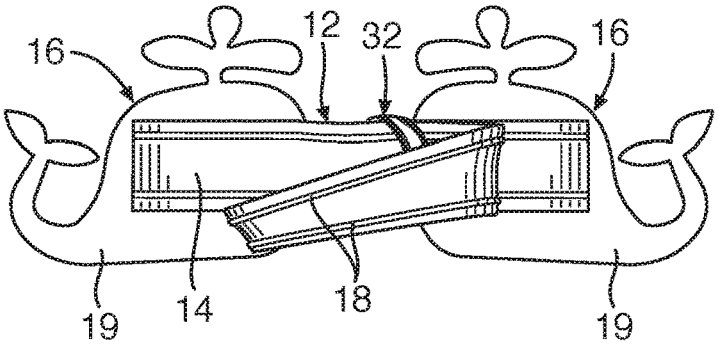
FIG. 7 is a rear elevation view thereof.
Figure 8:
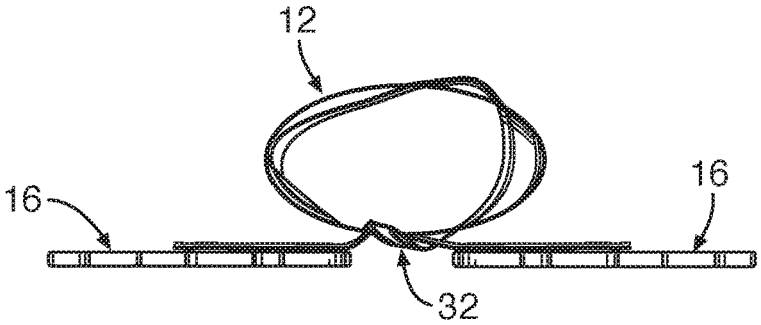
FIG. 8 is a top plan view thereof, the bottom plan view being a virtual mirror image thereof.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Referring to FIG. 1 through 5B, specifically, while referring to FIGS. 1 through 13A to 13M, generally, an apparatus 10 in accordance with the invention may include a band 12. The band 12 is a composed of an open field 14 or expanse 14, constituting the bulk of material 14 in the band 12 and containing a grip 16 at each end thereof. The grip 16 may be thought of as a decorative element 16 or emblem 16, and may have an image 17 on the front face thereof.

The field 14 may be stabilized along the length of the band 12 by one or more ribs 18. Ribs 18 may be selected to be of a size (e.g., effective diameter) and material to make them malleable or at least yieldable, as those and related terms are used in the engineering art and are used here in that ordinary meaning.

Once forced beyond a yield limit, they will permanently deform (yield) to remain in that position. Accordingly, the ribs 18 may be bent by finger pressure of a user and thereafter maintain their new shape. Thus, the ribs 18 have sufficient strength and stiffness to support themselves, the band 12, the field 14, and the shapes thereof generally. They will also support the weight and positioning of the grips 16 or emblems 16 on the ends of the band 12.

In general, it has been found most effective to have the ribs 18 spaced from each other across the band 12. To this end, two ribs 18 have been found very effective. A single rib 18 running longitudinally (axially) along the center of the band 12 or through the field 14 of the band 12 is functional. However, it is less stable. It is more difficult to arrange reliably to hold the locations of the emblems 16 (especially in rotation about a longitudinal axis) in use.

Thus, in many situations, at least two ribs 18 have demonstrated much better support and stability for use, application, and in maintaining relative locations of the grips 16 or emblems 16 on the ends of the band 12. Three ribs 18, four ribs 18, or more may be relied upon, depending upon effective diameter across the axial cross section of each rib 18.

For example, a thinner wire may provide adequate axial strength. Meanwhile, a comparatively thinner wire may be more easily obscured inside the band 12 without such a pronounced presence (bulk). On the other hand, a larger diameter for the ribs 18 may provide greater stability and ability to be formed, manipulated, and presented with more of the overall length 20 thereof cantilevered or unsupported.

Thus, any number of ribs 18 may be suitable, and may be selected for their dimensions, material properties (strength, stiffness, maximum yield stress, yield deflection), and so forth. An ability to cut the ribs 18 during a manufacturing process may also be a factor. For example, cutting the band 12 to a specific length 20 from stock such as a roll, of field material 14, may be a consideration in selection of materials and cross sectional for the ribs 18.

The expression "diameter" means effective diameter. That is, in an engineering context, diameter applies to a circular cross section. In many environments or embodiments, a rib 18 need not have a circular cross section. For example, a rectangular cross section, or other polygonal shape of any number of sides, or the like may be an option. To the extent that a shape is not a regular circular cross section, the effective diameter is four times the area divided by the perimeter exposed to the surrounding environment (wetted perimeter). This is an engineering term of art and may be used to render an equivalent to diameter whenever a cross section of material is not round.

The back face of each emblem 16 need not include the same image 17 as a front face. For example, a mirrored silhouette 19 of the emblem 16 may be the only image 17 visible. As a practical matter, a presentation will typically involve the front face images 17 being visible, and the back faces or silhouettes 19 being unavailable and unnecessary as to their presentability.

Typically, a length 20 of the band 12 may be selected in accordance with the particular application. Similarly, the width 22 of a band 12 may be subject to the same considerations. Larger widths 22 are more difficult to twist together than narrower widths 22. By the same token, a thickness 24 of a band 12 may actually be dominated by the ribs 18. In many embodiments, the actual thickness 24 receives a much greater contribution from the diameter of a rib 18 than from the actual thickness of the field material 14.

For example, the field material 14 may be Mylar™, polyethylene, paper, other polymeric film, paper-backed polyethylene film, ribbon, fabric, gauze, wire screen, or the like. Other material capable of having a length 20 and width 22 may be used as the material for the field 14. Likewise, ribs 18 may be located at the outermost edges of the width 22, at the center, at all three of those locations, or at additional intermediate locations. Thus, any or all of those locations of the ribs 18 within the width 22 of the band 12 are considered legitimate possibilities. Each has its benefits and burdens.

Referring to FIGS. 3 through 5B, and FIGS. 1 through 13M generally, an emblem 16 or grip 16 may have its own length 26, height 28, and thickness 30. In fact, in certain embodiments, the entire band 12 and emblem 16 together may be cut from a single expanse or stock of field material 14. Ribs 18 may be embedded therein between layers at the time of lamination, added before or after die cutting, or fastened on before or after emblems 16 are added.

Again, manufactured techniques may be varied. An advantage of cutting by a die provides for rapid output of individual devices 10 with the band 12 and emblem 16 all provided from the field material 14 in a single cut. On the other hand, the metal in ribs 18 may be hard (literally, and damaging) on a die. The metal ribs 18 will require harder tooling, such as harder tool steels, for such a die during manufacturing. Likewise, the limitations of emblems 16 and the images 17 contained thereon may be limited by die cutting.

Nevertheless, emblems 16 may be added on top of the main grip portion 16 or emblem 16 die cut into the field material 14 of a device 10 as part of the band 12, at each end thereof. However, such an additive, assembled configuration minimizes the value of a single-step, die cutting in the first place.

In the illustrated embodiment, the grips 16 or emblems 16 may be added to the bands 12, providing many options for field materials 14, and many options for emblems 16. This provides for reduced requirements on inventory of various bands 16 and various emblems 16.

Emblems 16 may be applied to both faces of the band 12. However, since the presentation will typically show the image 17 forward and the silhouette 19 rearward, there is little justification for making the emblems 16 or grips 16 decorative on both faces of the band 12.

Referring to FIGS. 6 through 12, while continuing to refer generally to FIGS. 1 through 13M, a device 10 may be applied by a motion of wrapping and then twisting together the band 12 proximate each grip 16. For example, one can see in the illustrated embodiment, representations of an animal caricature secured to each end of a band 12. The field 14 is collapsed to a certain extent in order to twist the ribs 18 together to a yield point. Upon yielding, the ribs 18 will remain in that position.

Thus, the two images 17 of the grips 16 may be adjusted or juxtaposed exactly as desired, being held in place by the stiffness of the ribs 18. In this way, the emblems 16 may actually be complementary.

For example two different animals, two juxtaposed figures, such as a bride and groom, a baseball and a bat, a football and a helmet, a rake and hoe, shoes, two text emblems 16 such as an 'X' and an 'O,' or any other two complementary emblems 16 may be used in juxtaposition. By the same token, two emblems 16, such as two hearts 16, flowers, trees, etc., may be used, each with a different label or wording.

Figure 9:
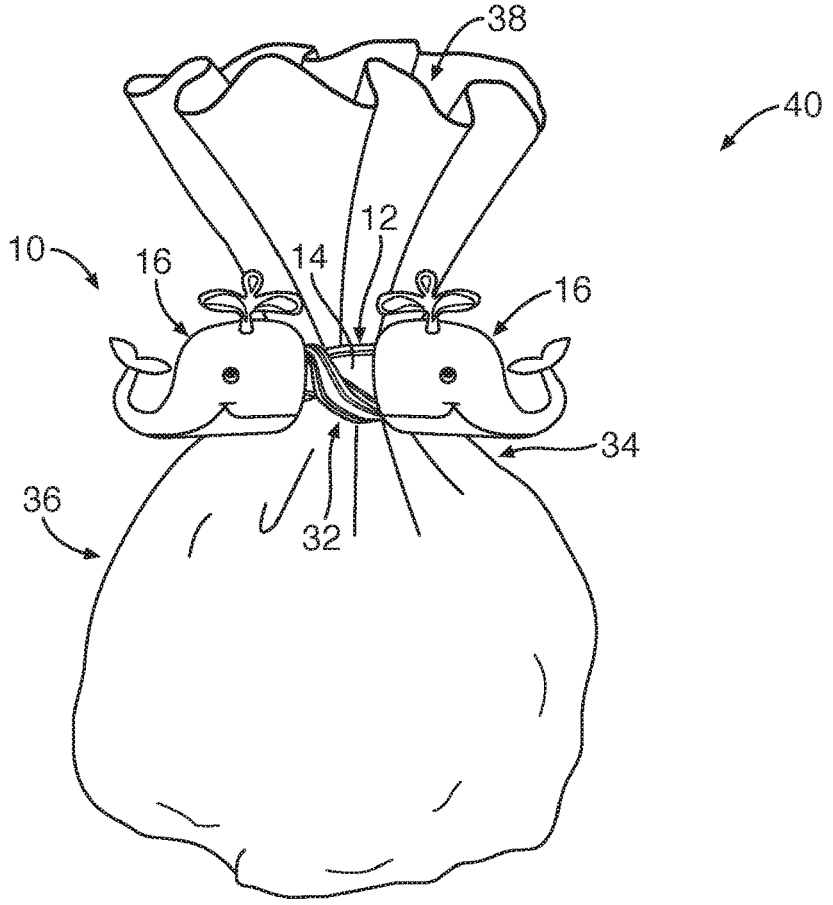
FIG. 9 is a front elevation view of one embodiment of a package and securement, in a closed configuration, in accordance with the invention.
Figure 10:
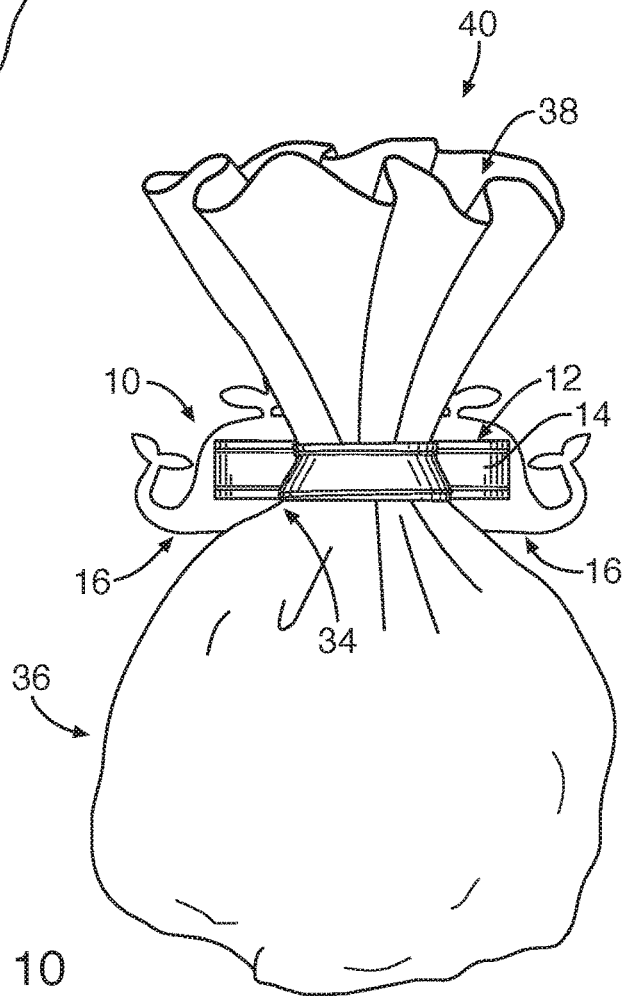
FIG. 10 is a rear elevation view thereof.

Referring to FIGS. 9 and 10, in use, a device 10 or apparatus 10 may be drawn around a neck 34 formed from a package 36 or container 36. The package 36 may simply be an expanse of wrapping paper 36 folded about a gift or other article. Drawn together at a neck portion 34, the package 36 may be secured by the twist 32 of a device 10. That is, the band 12 may be wrapped around the neck 34, drawn tight, and then twisted 32. Thereafter, the ribs 18 may be twisted, bent, or otherwise displaced in such a way that the grips 16 or emblems 16 are juxtaposed in exactly a desired relative position. The result is a mouth 38 of the package 36 that is fluted or contracted in a somewhat pleated or undulating fashion drawn down to a neck 34 to close the mouth 38 of the package 36.

Thus, a system 40 in accordance with the invention may include packaging material 36 or a package 36, in which a fluted mouth 38 is formed opposite the principal package 36, with a neck 34 gathered and secured by twisting 32 an apparatus 10, comprising a band 12 stiffened by ribs 18. Ribs 18 maintain the twist 32 and spread the field 14 to maintain its presentation.

Figure 11:
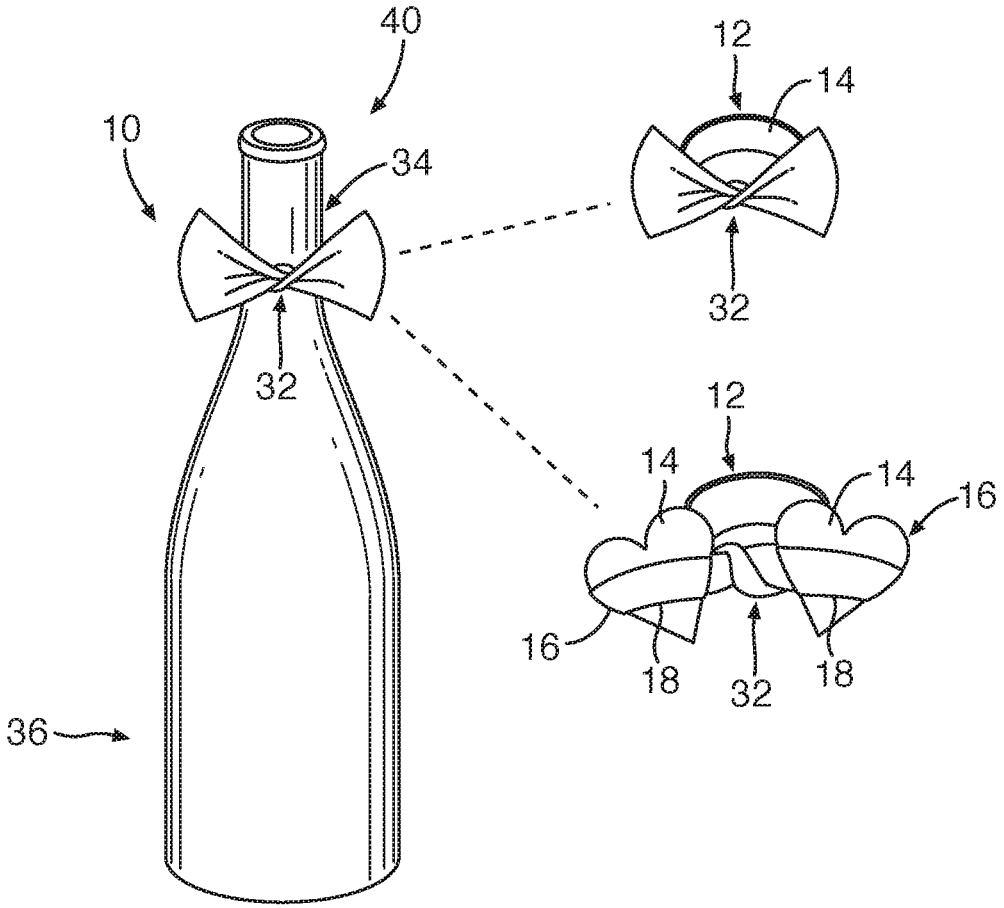
FIG. 11 is an upper frontal perspective view of an alternative embodiment of a package and a decorative securement in accordance with the invention.

Referring to FIG. 11, an alternative embodiment of a system 40 in accordance with the invention may rely on packaging 36 such as a container 36 preformed, such as a bottle, a sack, or an article of another shape. In the illustrated embodiment, alternative designs for an apparatus 10 may be wrapped around a neck 34 or other portion of the package 36.

Accordingly, a twist 32 in the band 12 may permanently deflect the ribs 18 (non-elastically) in order to secure the apparatus 10 to the package 36. Meanwhile, the treatment on the ends of the band 12 may be minimal, simply reflecting a bow-like treatment with the twist 32 at the center between the ends of the band 12.

Alternatively, emblems 16 of any variety may be imposed on (e.g., cut into or added to) the band 12. Again, the grips 16 or emblems 16 formed at the ends of the band 12 may simply be stamped or cut right into the field material 14 with the ribs 18 proceeding therethrough. In other embodiments, the emblems 16 or grips 16 may be added (e.g., glued, pinned, riveted, clamped, molded, cast, fastened, etc.) to the ends of the band 12 after cutting the band 12 to the desired length.

Figure 12:
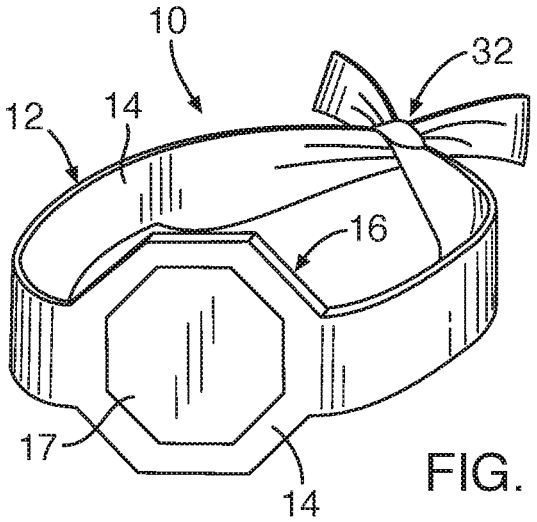
FIG. 12 is an upper frontal perspective view of an alternative embodiment of a securement in accordance with the invention, this one including a decorative emblem near the center of the band, rather than at the ends thereof.

Referring to FIG. 12, yet another alternative embodiment of an apparatus 10 in accordance with the invention may place the twist 32 near the ends of the band 12. The field material 14, being cut wider, forms the emblem area 16 with an image 17 as an option applied, printed, embossed, fastened, or otherwise imposed upon the field material 14.

In this embodiment, the tie 32 may be a less important portion of the band 12. It need not have any appropriate decoration 16*n* emblem 16, grip 16, or the like.

Inasmuch as the image 17 is between the ends of the band 12, multiple manufacturing options exist. For example, in the illustrated embodiment, the field material 14 is cut to a shape, and has a width 22 wider than that of the remaining portion of the band 12. Meanwhile, the image 17 may be added as an emblem 16 much as in FIGS. 1 through 10. For example, a band 12 may be fabricated to have a single width 22, with the emblem 16 being secured later to the band 12, having its own length 26, height 28, and thickness 30.

There is no fundamental limitation imposed on what the emblem 16 or grip 16 may be. Moreover, securements may include rivets, screws, pins, glues, laminations, clips, clamps, and other fasteners suitable for securing the emblem 16 to the band material 12 forming the field 14.

Again, multiple emblems 16 may be fitted on opposite sides (opposite surfaces) of the field material 14 but need not be. Any surface of the field material 14 secured in contact against a package 36 will not be viewed and will therefore not reap benefit from an image 17 thereon, let alone a second grip 16 or emblem 16 on that surface.

Figures 13, 13A, 13B, 13C, 13D, 13E, 13F, 13G, 13H, 13J, 13K, 13M:
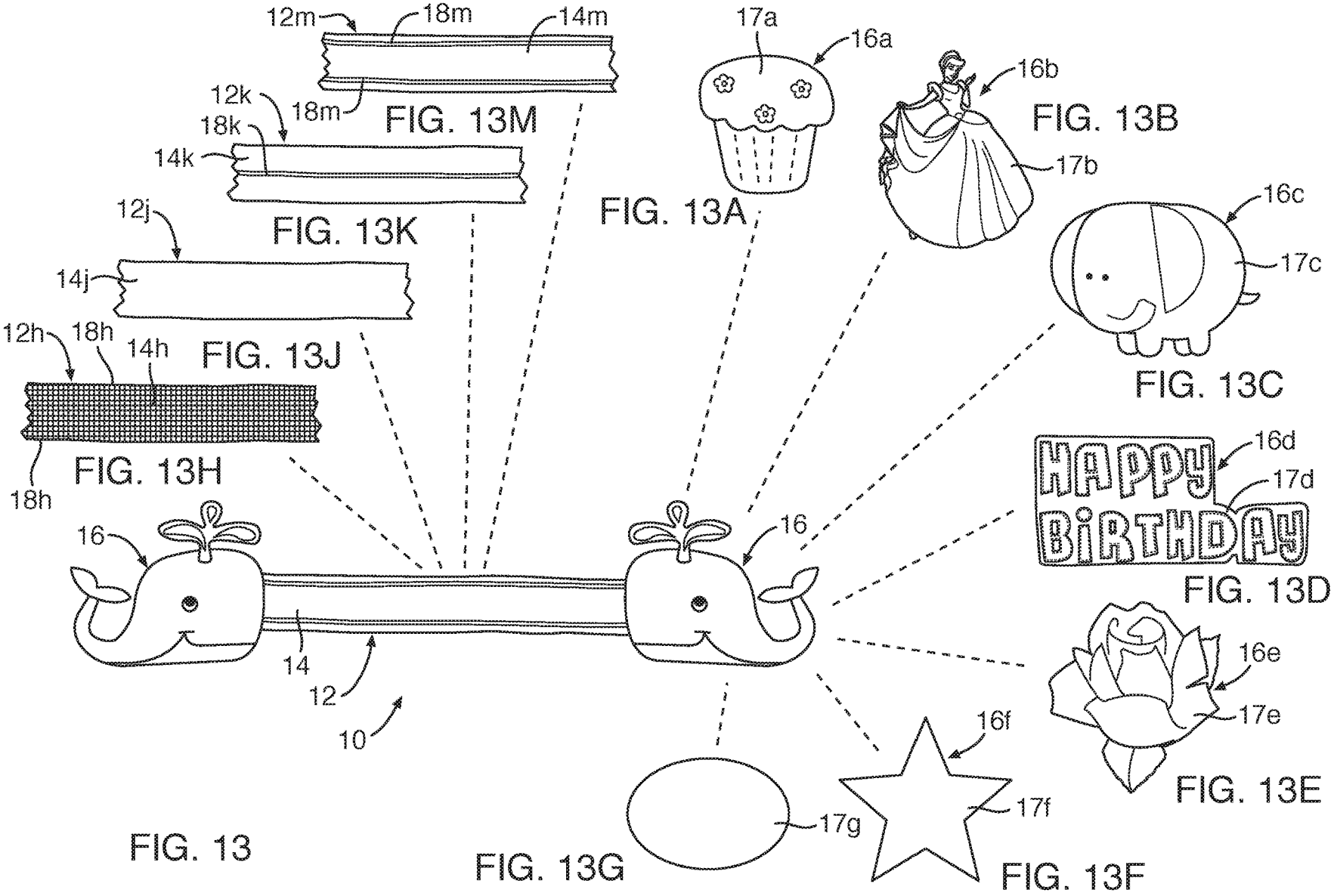

Referring to FIG. 13, including sub-FIGS. 13A through 13M, various embodiments of emblems 16 are illustrated. Meanwhile, each emblem 16 or grip 16 may include an image 17 or simply maintain a silhouette 19 on either both surfaces thereof (opposite sides of the thickness 30 thereof; see FIGS. 1 through 5B).

In the illustrated embodiment, an image 17*a* in FIG. 13A represents some type of a treat. For example, a cupcake, slice of cake, ice cream cone, or any other delicacy, including savory items or the like may be used to set the theme of the image of 17*a*.

Referring to 13B, a person may be represented by an image 17*b* associated with a theme. For example, a princess, a super hero, a bride and groom, an astronaut, or any other image 17*b* involving a person may be appropriate to set a theme for an apparatus 10 applied to a package 36.

Referring to FIG. 13C, an animal may serve as an image 17*c*, which may include a caricature of an animal. For example, many cartoon figures are animals or involve animals. Meanwhile, certain copyrighted images of persons such as the image 17*b* or animals 17*c* may be selected for implementation as grips 16 or emblems 16 with representative images 17 contained therein or printed thereon.

Referring to FIG. 13D, an image 17*d* may include or may contain simply a textual image 17*d* as the emblem 16*d*. One will note that each of the emblems 16*a*, 16*b*, 16*c*, 16*d* may be the substrate, or have multiple dimensions, such as two or three dimensional imagery, with corresponding images 17*a*, 17*b*, 17*c*, 17*d*. In some instances, the image 17 may tell the entire story or set the entire theme. In other embodiments, a textual image 17*d* may present a theme or message such as congratulations, graduation, anniversary, condolences, sympathies, well wishes, celebration event, or the like.

In other embodiments, an emblem 16 may include an image of an item such as a dessert 17*a*, a person 17*b*, or animal 17*c* combined with an appropriate theme in a text image 17*d*. In other embodiments, an emblem 16 on one end of a band 12 may include an image 17 as the emblem 16, while a text image 17*d* may be formed on the emblem 16 on the opposite end of the band 12.

Referring to FIG. 13E, other images 17*e* may include floral or other plant materials. For example, pine trees, Christmas trees, a potted plant, favorite flowers, or the like may serve as the image 17*e* setting a theme of an emblem 16*e*.

Meanwhile, other shapes, as illustrated in FIGS. 13F and 13G, may include a mere shape. An emblem 16*f* shaped as a star 17*f*, a sun 17*f*, a moon 17*f*, a rank symbol 17*f* or any logo, or the like may have meaning. Meaning may be common, cliché, or private to a sender or receiver of a package 36 decorated with an apparatus 10 and emblems 16.

Ultimately, an emblem 16*g* may simply be a clear panel 16*g* of basic shape, such as square, rectangle, oval, circle, polygon, or some other significant shape, such as a vehicle, an aircraft, a boat, or the like. One benefit of a smooth, blank emblem 16*g* is that an individual may create an image 17*g* desired, such as text, a figure, or the like. In other words, a blank medallion 16*g* or grip 16*g* may operate to provide the freedom to add an image 17*g* of text, figures, or both to the blank emblem 16*g* in FIG. 13G.

Likewise, referring to FIGS. 13H through 13M, a field material 14 may be shaped in any suitable manner. For example, the field material 14*h* may have ribs 18*h* spaced along the edges at the extremities of the width 22 of the band 12*h*. Meanwhile, the field material 14*h* may be sparse, such as a gauze 14*h* or screen 14*h*.

Referring to FIG. 13J, a simple ribbon 14*j* may serve as the band 12*j*. On the other hand, a single rib 18*k* in FIG. 13K may form the only stiffener 18*k* in the entire expanse of the field 14*k* of a band 12*k*. By the same token, one or more ribs 18*m* may stiffen the field material 14*m* of a band 12*m*. Any number of ribs 18*m* may be used. In this illustrated embodiment, the ribs 18*m* are slightly inside the overall width 22 of the band 12*m*, and may include more than two ribs 18*m*.

In other embodiments, the system may include one or more images, medallions,

The present invention may be embodied in other specific forms without departing from its fundamental functions or essential characteristics. The described embodiments are to be considered in all respects only as illustrative, and not restrictive. All changes which come within the meaning and range of equivalency of the illustrative embodiments are to be embraced within their scope.

Wherefore, we claim:

1. A method of applying a fastener, the method comprising:

providing a fastener having a length, width, and ends, the fastener comprising an expanse of a first material formed as a sheet, elongated in aspect ratio of length to width, both being greater than the thickness thereof, and stiffened by at least two ribs secured thereto and spaced from one another, a grip comprising an emblem formed of a second material distinct from the first material fixed to the expanse at a location along the length;

providing a containment formed of a sheeted material extending in three dimensions, wherein a thickness dimension thereof is orders of magnitude less than the remaining two dimensions;

gathering a region of the containment to form a neck;

orienting the fastener to surround the neck;

tightening the fastener to secure the shape of the neck;

securing the fastener by twisting the ribs across themselves at a location spaced away from the grip; and arranging at least one of the ends and the grip to form a decorative element on the neck.

2. The method of claim 1, wherein the ribs are constituted by wires formed of a malleable material.

3. The method of claim 2, wherein the ribs are wires formed of mild steel subject to yielding inelastically in response to twisting.

4. The method of claim 1, wherein the grip constitutes an emblem having a shape representing a silhouette of an object.

5. The method of claim 4, comprising an image formed on the grip and corresponding to the shape.

6. The method of claim 5, wherein the fastener has multiple grips.

7. The method of claim 6, wherein the grips are secured to the expanse proximate the ends.

8. The method of claim 7, comprising yielding the ribs to arrange an orientation of the grips and a positioning thereof with respect to one another.

9. The method of claim 8, wherein each of the grips bears an image and yielding further comprises positioning the grips to render the images all viewable from the same vantage or viewpoint.

10. The method of claim 1, wherein:

the first material is selected from a first plastic, a first fabric, a ribbon, and a first paper;

the second material is selected from a second plastic, a wood derived product, and a fabric; and the neck is formed in one of a flat sheet gathered by its edges, a bag near its opening, and an end of a rolled sheet.

11. An apparatus as a fastener comprising:

a field constituted by an expanse of a first material defining a length, width, and ends and formed of a sheet, the expanse being elongated in aspect ratio of length to width, both being greater than the thickness thereof;

at least two ribs secured to the field and spaced from one another and capable of stiffening the field to hold rigidly under the influence of its own weight;

a grip comprising an emblem greater than the width, formed to have a shape representing a thematic image and sized for gripping separately from the field;

the field sized to be capable of securing a gathered neck of a sheeted material to form a closed containment of the sheeted material by tightening around the neck, yielding of the at least two ribs by twisting together between the ends; and the ribs, sized, shaped, positioned in the field, and of a material capable of fixedly positioning the grip in a desired position and orientation with respect to the neck.

12. The apparatus of claim 11, wherein the grip constitutes a decorative element distinct from the field by itself.

13. The apparatus of claim 12, comprising an image on the grip.

14. The apparatus of claim 13, comprising two grips positioned at the ends of the field.

15. The apparatus of claim 14, wherein the ribs are capable of fixing the grips with respect to one another in an arbitrary orientation selected by a user.

16. The apparatus of claim 15, wherein the grips are each formed to provide at least one of the same silhouette and the same image.

17. The apparatus of claim 11, comprising two grips formed of a second material distinct from the first material of the field.

18. The apparatus of claim 17, wherein the grips are capable of forming a combined decorative element, in addition to an individual decorative element of each alone, on the neck by orienting them with respect to one another and yielding the ribs to render that orienting fixed.

19. The apparatus of claim 11, wherein:

the ribs are wires formed of mild steel subject to yielding inelastically in response to twisting;

the grip constitutes an emblem having a shape representing a silhouette of an object;

the grip is secured to the field proximate one of the ends, and another grip is secured to the field at the remaining end;

each of the grips bears an image and yielding further comprises positioning the grips to render the images all viewable from the same vantage or viewpoint;

the first material is selected from a first plastic, a first fabric, a ribbon, and a first paper;

the grips are formed of a second material selected from a second plastic, a wood derived product, and a fabric; and the neck is formed in one of a flat sheet gathered by its edges, a bag near its opening, and an end of a rolled sheet.

20. A method of applying a fastener, the method comprising:

providing a fastener having a length, width, and ends, the fastener comprising a field constituted by an expanse of a first material formed as a sheet, elongated in aspect ratio of length to width, both being greater than the thickness thereof, and stiffened by at least two ribs secured thereto and spaced from one another, and grips at the ends comprising an emblem formed of a second material distinct from the first material fixed to the expanse at a location along the length, wherein the grips each constitute an emblem having a shape representing a silhouette of an object and bear an image corresponding to the shape;

providing a containment formed of a sheeted material extending in three dimensions, wherein a thickness dimension thereof is orders of magnitude less than the remaining two dimensions;

gathering a region of the containment to form a neck therein;

orienting the fastener to surround the neck;

tightening the fastener to secure the shape of the neck;

securing the fastener by twisting the ribs across themselves at a location spaced away from the grip, wherein the ribs are constituted by wires formed of a malleable material capable of yielding inelastically in response to twisting;

arranging the grips to form a combined decorative element on the neck through positioning the grips to render the images fixed to all be viewable from the same vantage point by virtue of the yielding;

wherein the first material is selected from a first plastic, a first fabric, a ribbon, and a first paper, the second material is selected from a second plastic, a wood derived product, and a fabric, and the neck is formed in one of a flat sheet gathered by its edges, a bag near its opening, and an end of a rolled sheet.

* * * * *